US010806240B2

(12) United States Patent
Martinez

(10) Patent No.: US 10,806,240 B2
(45) Date of Patent: Oct. 20, 2020

(54) BOUTONNIERE ATTACHMENT

(71) Applicant: Elizabeth C. Martinez, Avon Lake, OH (US)

(72) Inventor: Elizabeth C. Martinez, Avon Lake, OH (US)

( * ) Notice: Subject to any disclaimer, the term of this patent is extended or adjusted under 35 U.S.C. 154(b) by 0 days.

(21) Appl. No.: 16/372,959

(22) Filed: Apr. 2, 2019

(65) Prior Publication Data

US 2019/0307234 A1 Oct. 10, 2019

Related U.S. Application Data

(60) Provisional application No. 62/653,154, filed on Apr. 5, 2018.

(51) Int. Cl.
*A47F 5/08* (2006.01)
*A45F 5/08* (2006.01)

(52) U.S. Cl.
CPC ..... *A45F 5/08* (2013.01); *Y10T 24/1309* (2015.01)

(58) Field of Classification Search
CPC ..... Y10T 24/1306; Y10T 24/1309; Y10T 24/1365; A45F 5/08
See application file for complete search history.

(56) References Cited

U.S. PATENT DOCUMENTS 3,088,295 A * 5/1963 Haines ..... A44B 1/04 63/20
5,426,828 A * 6/1995 Kusano ..... A44B 1/30 24/103
6,715,184 B1 * 4/2004 Droschak ..... A45F 5/08 24/13
7,013,675 B2 * 3/2006 Marquez-Pickering ..... A44C 7/003 63/1.11
2010/0287766 A1 * 11/2010 Peterson ..... A45F 5/08 29/798

* cited by examiner

*Primary Examiner* — Robert Sandy
(74) *Attorney, Agent, or Firm* — Tucker Ellis LLP

(57) ABSTRACT

Provided is a boutonniere attachment device for attaching a decoration to an article of clothing. The boutonniere attachment includes a shaft having first and second ends, a first fastener attached to the shaft proximate the first end, the first fastener including a flange portion attached to the shaft and a removable attachment, and a second fastener attached to the shaft proximate the second end, the second fastener including a flange portion attached to the shaft and a removable attachment.

16 Claims, 11 Drawing Sheets

BOUTONNIERE ATTACHMENT

RELATED APPLICATIONS

This application claims the benefit of U.S. Provisional Application No. 62/653,154 filed Apr. 5, 2018, which is hereby incorporated herein by reference.

FIELD OF INVENTION

The present invention relates generally to boutonnieres, and more particularly to boutonniere attachments.

BACKGROUND

A boutonniere is a floral decoration that is typically worn on the left-side lapel of a tuxedo, a suit jacket, or other article of clothing. Boutonnieres are usually reserved for special occasions such as proms, homecomings, funerals, or weddings. Traditionally, to attach a boutonniere to a jacket, boutonnieres were pushed through the lapel buttonhole. Modern trends, however, include pinning boutonnieres directly to the lapel of the clothing using a straight pin, for example.

SUMMARY OF INVENTION

The present application provides a boutonniere attachment device for attaching a boutonniere to the lapel of an article of clothing. The boutonniere attachment comprises a shaft having first and second ends, a first fastener attached to the shaft proximate the first end, and a second fastener attached to the shaft proximate the second end. The first and second fasteners each include a flange portion attached to the shaft and a removable attachment.

According to an aspect, a boutonniere attachment is provided that includes a shaft having first and second ends, a first fastener attached to the shaft proximate the first end, the first fastener including a flange portion attached to the shaft and a removable attachment, and a second fastener attached to the shaft proximate the second end, the second fastener including a flange portion attached to the shaft and a removable attachment.

According to another aspect, an attachment configured to be attached to a decoration is provided. The attachment includes a shaft having first and second ends, a first fastener attached to the shaft proximate the first end, the first fastener including a flange portion attached to the shaft, a pin projecting from the flange portion, and a removable attachment removably attached to the pin, and a second fastener attached to the shaft proximate the second end, the second fastener including a flange portion attached to the shaft, a pin projecting from the flange portion, and a removable attachment removably attached to the pin.

According to another aspect, a method of attaching a decoration to an article of clothing using a boutonniere attachment is provided, where the attachment has a shaft, a first fastener attached to the shaft proximate the first end, the first fastener including a flange portion attached to the shaft, a pin projecting from the flange portion, and a removable attachment removably attached to the pin, and a second fastener attached to the shaft proximate the second end, the second fastener including a flange portion attached to the shaft, a pin projecting from the flange portion, and a removable attachment removably attached to the pin. The method includes placing a stem of the decoration abutting the shaft of the boutonniere attachment, attaching the stem of the decoration to the shaft of the boutonniere attachment, piercing the article of clothing with the pins of the boutonniere attachment, and attaching the removable attachments to the pins of the boutonniere attachment to trap the clothing between the pins and the flanges.

The foregoing and other features of the application are described below with reference to the drawings.

DETAILED DESCRIPTION

Figure 1:
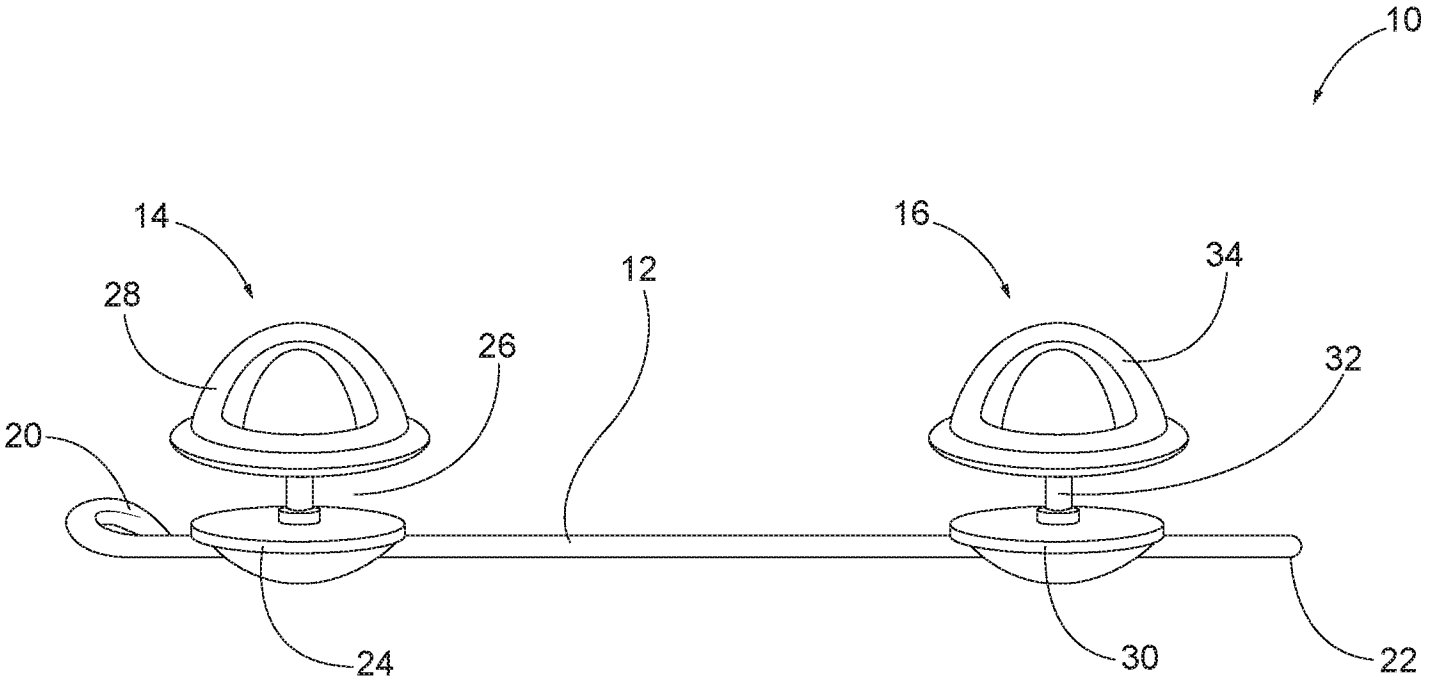
FIG. 1 is a front view of an exemplary boutonniere attachment.

Referring initially to FIGS. 1-5, an exemplary attachment is shown generally at reference numeral 10. The attachment 10, which is herein described as a boutonniere attachment but may be applicable to other suitable uses, includes a shaft 12 and one or more fasteners, and as shown first and second fasteners 14 and 16 attached to the shaft 12. The shaft 12 has a first end 20 and a second end 22. The first end 20 may be looped, and the second end 22 may be straight. It will be appreciated, however, that both may be straight, looped, or the opposite as shown. The shaft 12 may be formed from any suitable material, such as metal, and may be any suitable color. The shaft 16 may have a suitable length, such as between five and six centimeters, although it will be appreciated that the length may vary based on application. Additionally, the shaft 16 may be substantially straight, as illustrated, or may be formed or bent into various shapes based on the desired application.

The first and second fasteners 14 and 16 may be attached to the shaft 12 in any suitable manner, such as by adhesive, welding, etc. The first fastener 12 may include a flange 24, a pin 26 projecting from the flange 24, and a removable attachment 28. Similarly, the second fastener 16 may include a flange 30, a pin 32 projecting from the flange 30, and a removable attachment 34. The first and second fasteners 14 and 16 may be spaced from one another along the length of to the shaft 12 for stability. For example, the first fastener 14, and in particular the flange 24 may be attached to the shaft 12 proximate the first end 20, and the second fastener 16, and in particular the flange 30 may be attached to the shaft 12 proximate the second end 22. The flange 24 and pin 26 may be unitary or formed as two pieces and attached together. Similarly, the flange 30 and the pin 32 may be unitary or formed as two pieces and attached together.

Figure 2:
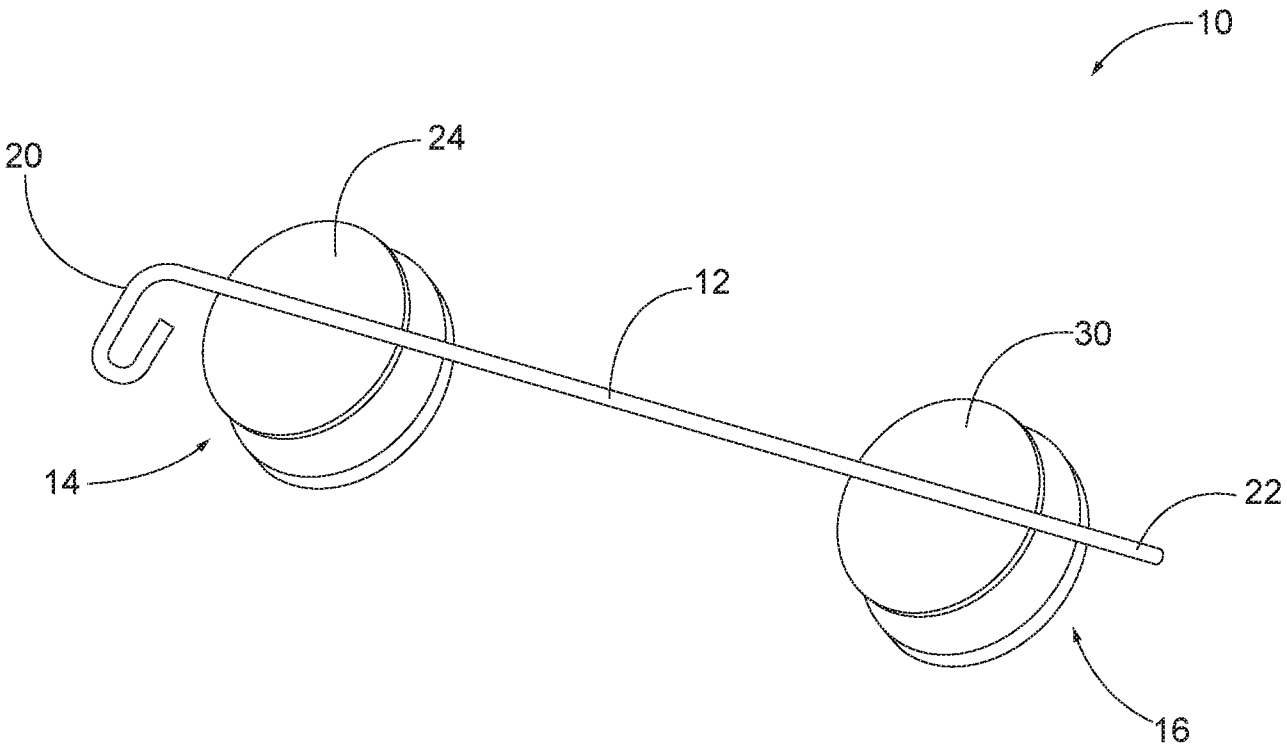
FIG. 2 a perspective view of the attachment.
Figure 3:
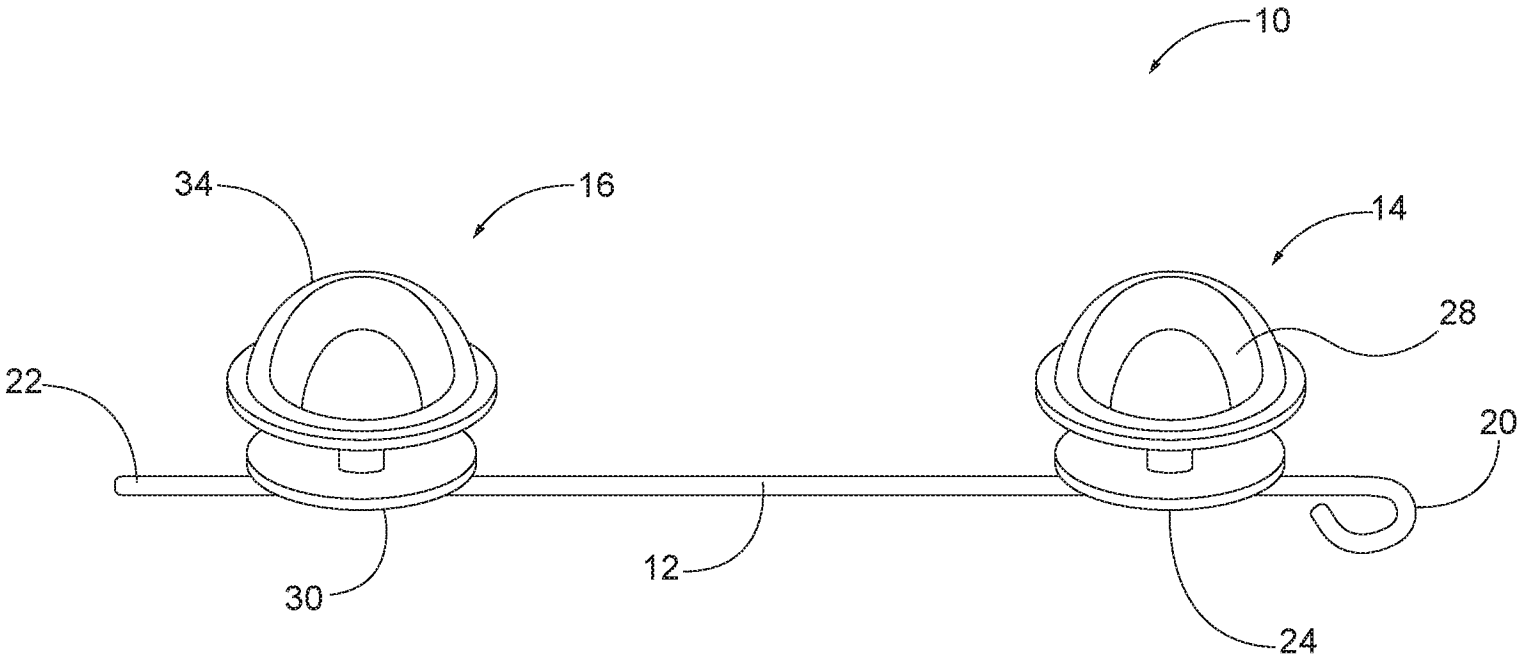
FIG. 3 is a rear view of the attachment.
Figure 4:
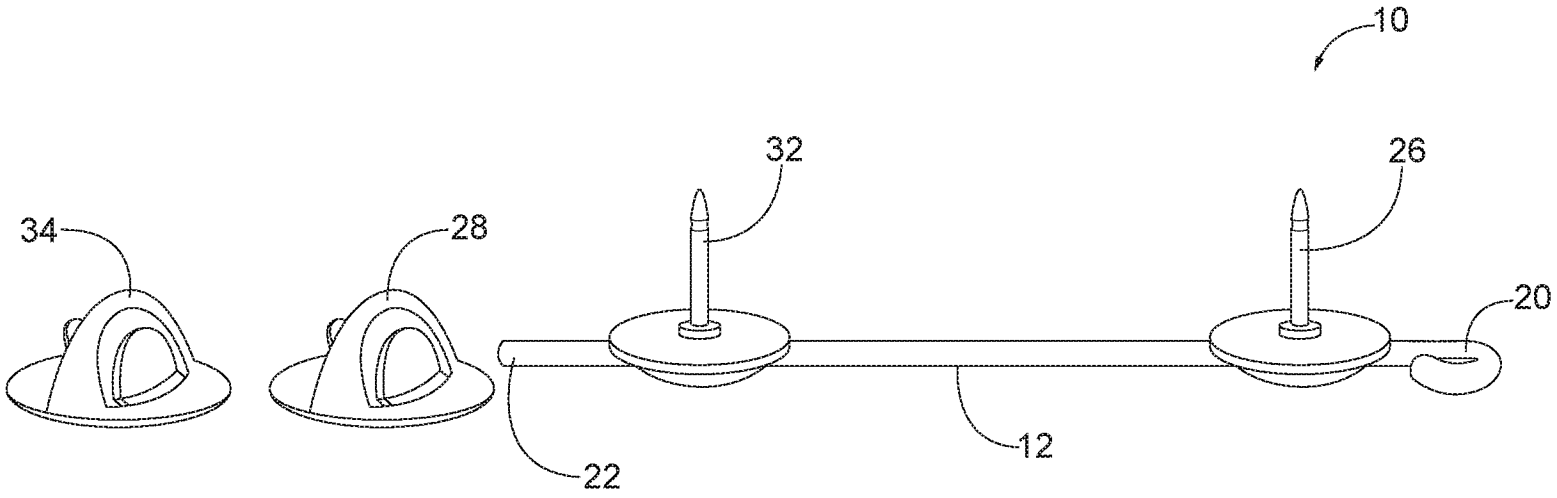
FIG. 4 is a rear view of the attachment with butterfly clutches removed.
Figure 5:
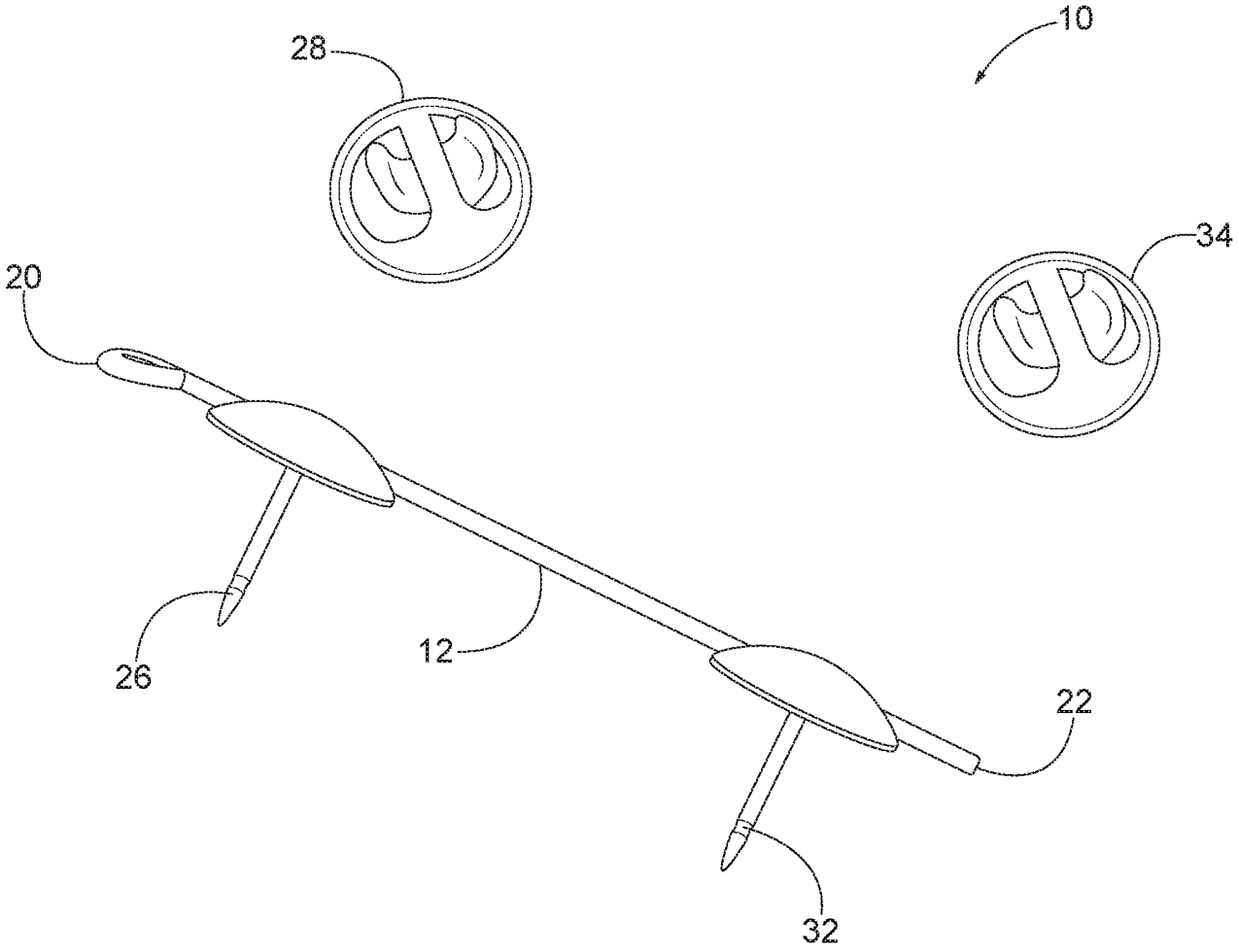
FIG. 5 is a top view of the attachment with the butterfly clutches removed.
Figure 6:
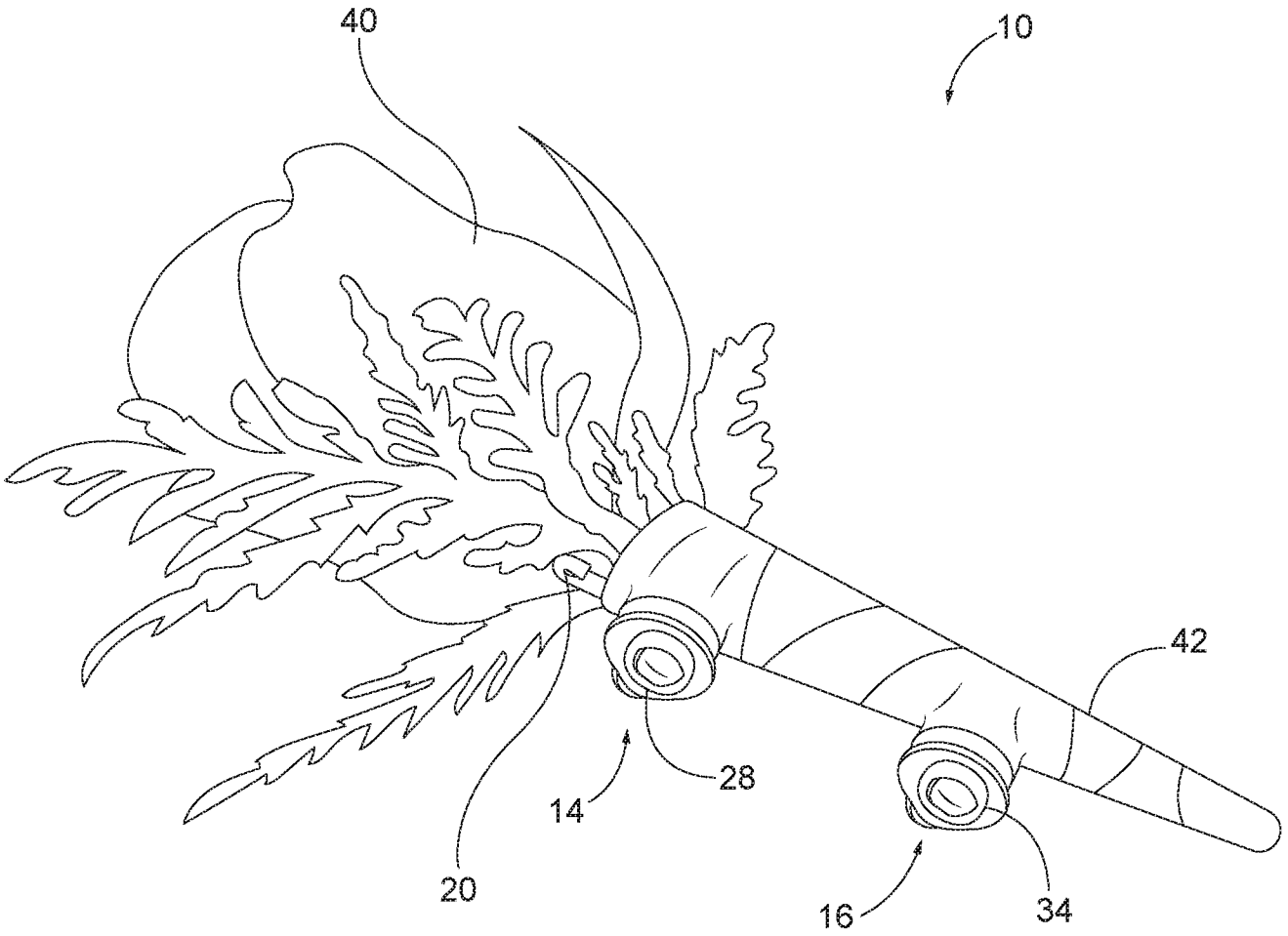
FIGS. 6 and 7 are views of the attachment assembled to a flower.
Figure 7:
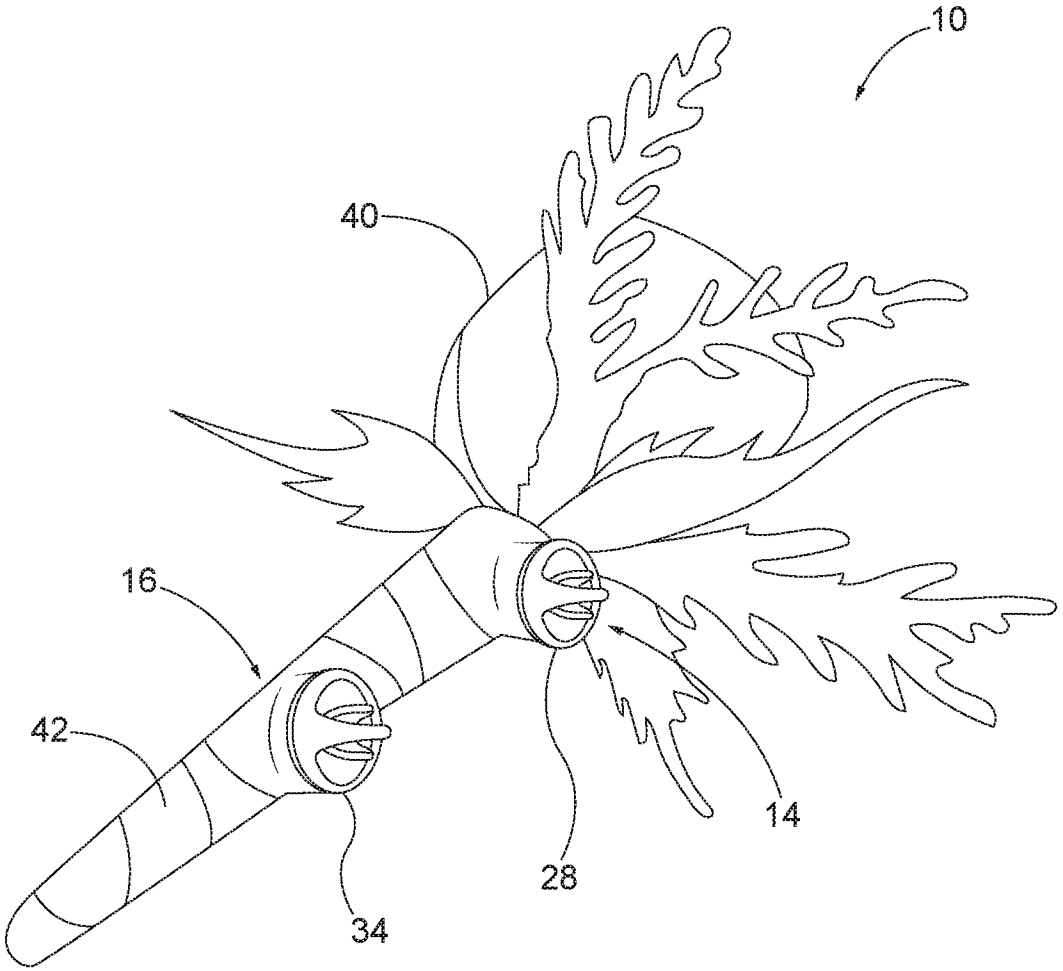

The removable attachments 28 and 34 may be removably attached to the pins 26 and 32, respectively. FIGS. 1-3 show the removable attachments 28 and 34 secured to the pins 26 and 32. FIGS. 4 and 5 show the removable attachments 28 and 34 removed from the pins 26 and 32. The removable attachments 28 and 34 may be butterfly clutches, for example as illustrated in FIGS. 1-5. Alternatively, the removable attachments 28 and 34 may be any similar alternative (e.g., screw back attachment, jewelry clutch, rubber clutch, cufflink type attachment, etc.).

Turning now to FIGS. 6-9, a decoration 40, such as a boutonniere, may be attached to the boutonniere attachment 10, as shown. The boutonniere attachment 10 provides an easier, more effective, and more robust method for a user to attach a decoration 40, such as to a lapel of a jacket than mounting with a straight pin or mounting using a lapel buttonhole. That is, a straight pin is difficult to maneuver and to attach to a jacket. The difficulty associated with straight pins may also lead to minor injuries to the user associated with maneuvering the sharp straight pin. The difficultly may also require a user to ask for assistance to adequately secure the boutonniere to a suit jacket. In addition, mounting a boutonniere using a straight pin or lapel buttonhole may result in unsatisfactory movement or the detachment of the boutonniere over a period of use.

To attach the boutonniere attachment 10 to the decoration 40, the stem of the decoration 40 may be placed near the shaft 12 of the boutonniere attachment 10, and optionally the removable attachments 28 and 34 may be removed from the pins 26 and 32. A suitable attachment, such as a strip material, such as a floral tape 42 may be wrapped around the stem of the decoration 40 and the shaft 12 to attach the stem to the shaft 12. The loop 20 may be left uncovered by the floral tape 42 near a head of the boutonniere, for example as a grip for the user when wrapping.

Figure 8:
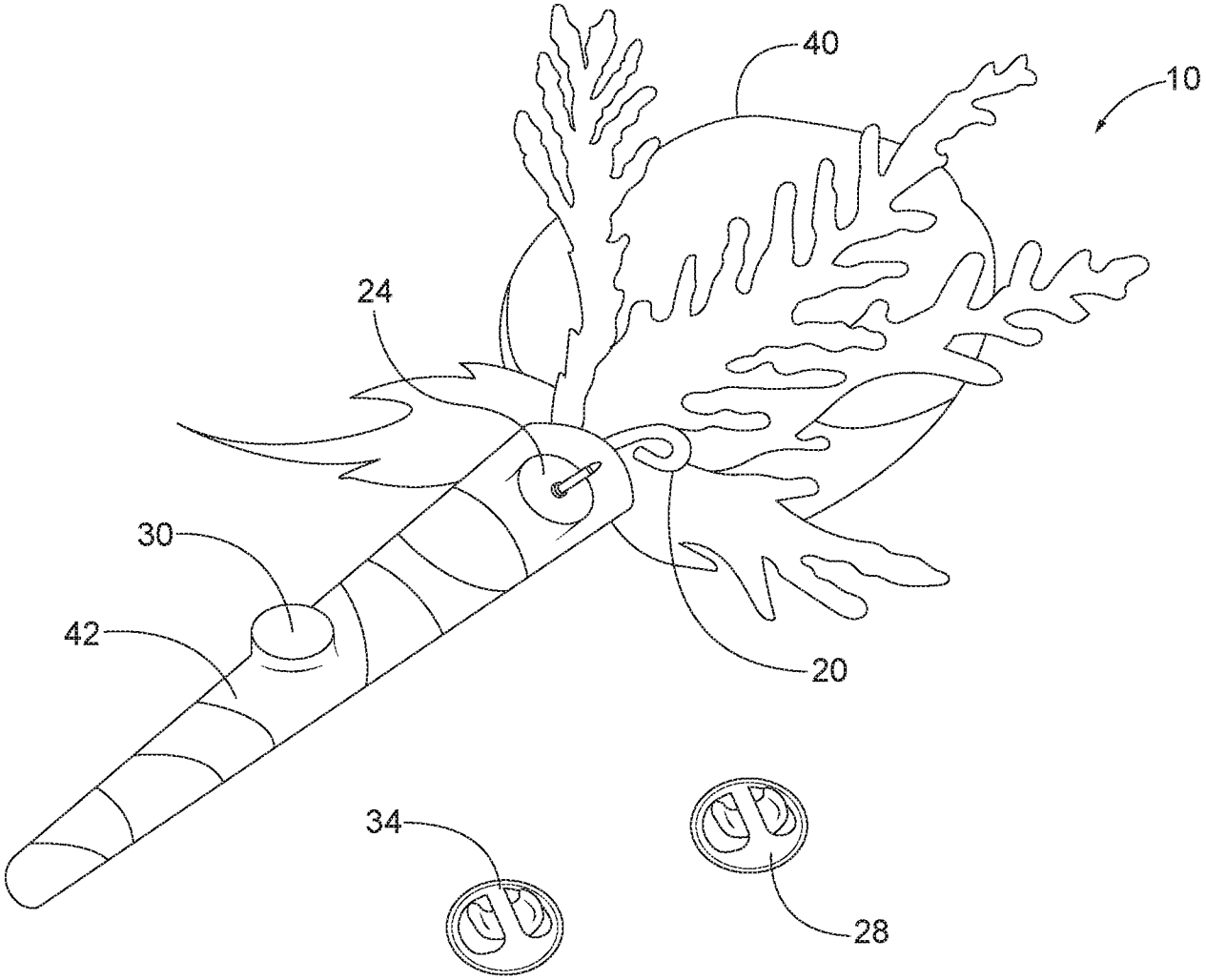
FIGS. 8 and 9 are views of the attachment assembled to the flower with the butterfly clutches removed.
Figure 9:
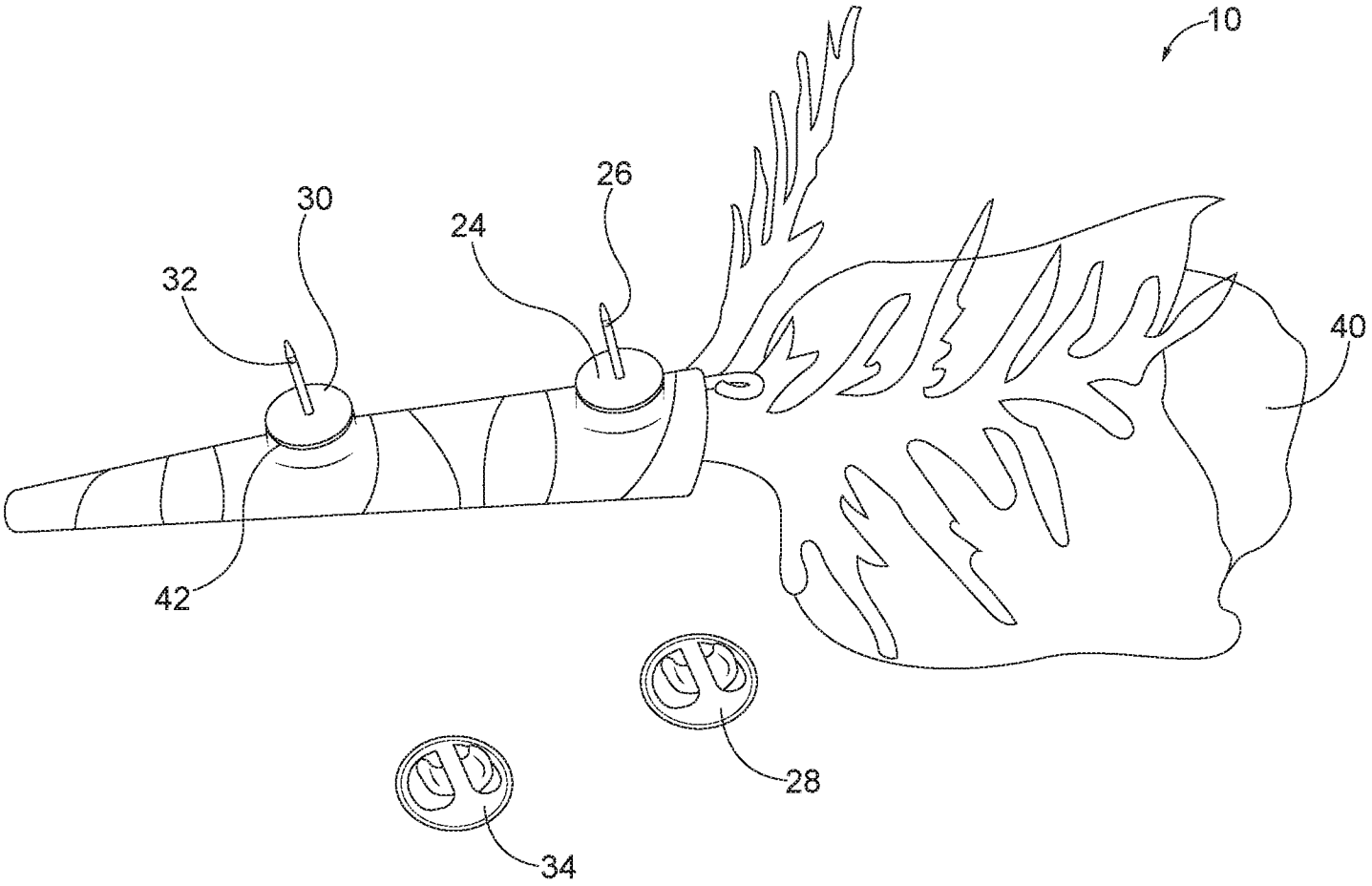

The flanges 24 and 30, as shown in FIG. 8, may be wrapped in floral tape 42 along with the shaft 12. Wrapping the flanges 24 and 30 in floral tape 42 may increase the surface area of the boutonniere attachment 10 wrapped in floral tape 42, for example as additional support. The additional support may prevent movement of the decoration 40 in relation to the boutonniere attachment 10. Additionally, the floral tape 42 may be wrapped over the pins 26 and 32 with the pins piercing through the tape. Alternatively, the flanges 24 and 30 may be left unwrapped in floral tape 42.

After the boutonniere 40 is attached to the boutonniere attachment 10, the boutonniere attachment 10 may be secured to an article of clothing, such as a suit jacket. To secure to the clothing, the user removes or confirms that the removable attachments 28 and 34 have been removed from the pins 26 and 32. The user then pierces the fabric of the article of clothing, such as the lapel, with the pins 26 and 32. The pins 26 and 32 may protrude through the lapel of the clothing, while the shaft 12 and decoration 40 remain at a desired position on the outside of the lapel.

The boutonniere attachment 10 is then secured to the lapel of the clothing by attaching the removable attachments 28 and 34 to the pins 26 and 32, respectively. The removable attachments 28 and 34 are attached from the interior of the clothing or underside of the lapel. It will be appreciated that securing the boutonniere attachment 10 to an article of clothing does not require a traditional straight pin or a lapel buttonhole. For this reason, the boutonniere attachment 10 may be placed in any desired location or orientation. In addition, the boutonniere attachment 10 may prevent unwanted movement or detachment of the decoration 40 over an extended period of use (i.e., wearing a boutonniere for an extended amount of time).

In other embodiments, the decoration 40 may be attached to the boutonniere attachment 10 in any number of ways (i.e., other than floral tape 42). For example, a decoration 40 may be attached using traditional tape, glue, adhesive, ribbons, bows, or other similar alternatives. The decoration 40 may be attached to the boutonniere attachment 10 in a temporary manner. In this way, the attachment 10 may be reused any number of times for the same or other occasions. Alternatively, the decoration 40 may be permanently attached to the boutonniere attachment 10, if desired.

The decoration 40 may be any number of related items. For example, a boutonniere, a living flower, a non-living flower, or other floral decoration may be used. Alternatively, any decorative item, floral or non-floral, may also be attached to the boutonniere attachment 10, as desired.

Figure 10:
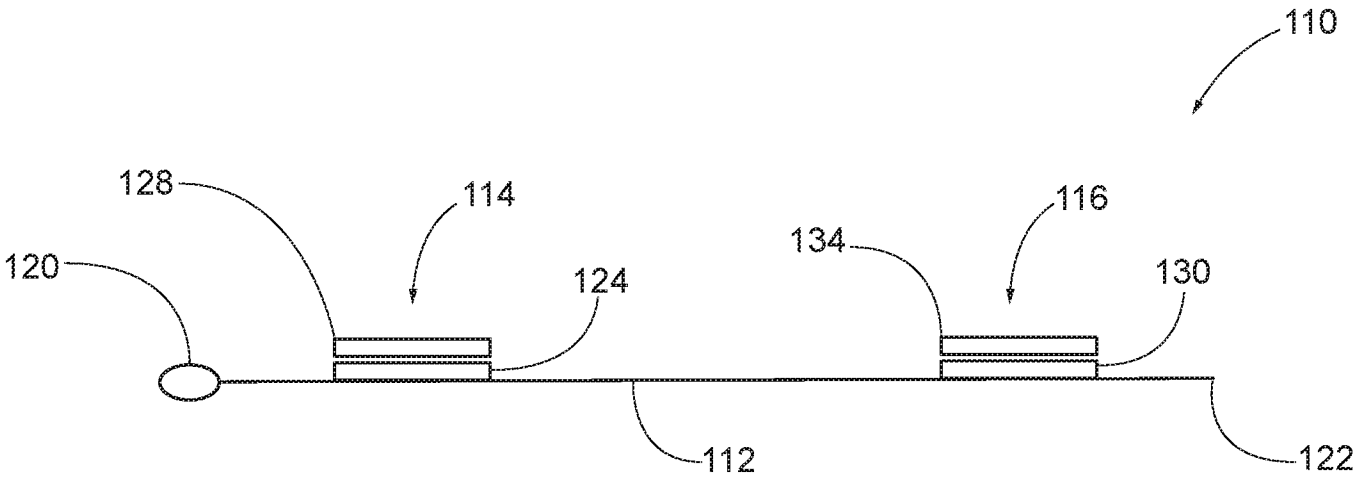
FIG. 10 shows an exemplary boutonniere attachment.

Turning now to FIG. 10, an exemplary embodiment of the boutonniere attachment is shown at 110. The boutonniere attachment 110 is substantially the same as the above-referenced boutonniere attachment 10, and consequently the same reference numerals, but indexed by 100, are used to denote structures corresponding to similar structures in the boutonniere attachments. In addition, the foregoing description of the boutonniere attachment 10 is equally applicable to the boutonniere attachment 110 except as noted below.

The boutonniere attachment 110 includes a shaft 112 and one or more fasteners, and as shown first and second fasteners 114 and 116 attached to the shaft 112. The shaft 112 has a first end 120 and a second end 122. The first end 120 may be looped, and the second end 122 may be straight.

The first and second fasteners 114 and 116 may be attached to the shaft 112 in any suitable manner, such as by adhesive, welding, etc. The first fastener 112 may include a flange 124 and a removable attachment 128. Similarly, the second fastener 116 may include a flange 130 and a removable attachment 134. The first and second fasteners 114 and 116 may be spaced from one another along the length of to the shaft 112 for stability. For example, the first fastener 114, and in particular the flange 124 may be attached to the shaft 112 proximate the first end 120, and the second fastener 116, and in particular the flange 130 may be attached to the shaft 112 proximate the second end 122.

The removable attachments 128 and 134 may be magnetically coupled to the flanges 124 and 130, respectively. The removable attachments 128 and 134 may be magnets, the flanges 124 and 130 may be magnets, or any combination thereof to achieve magnetic coupling.

Figure 11:
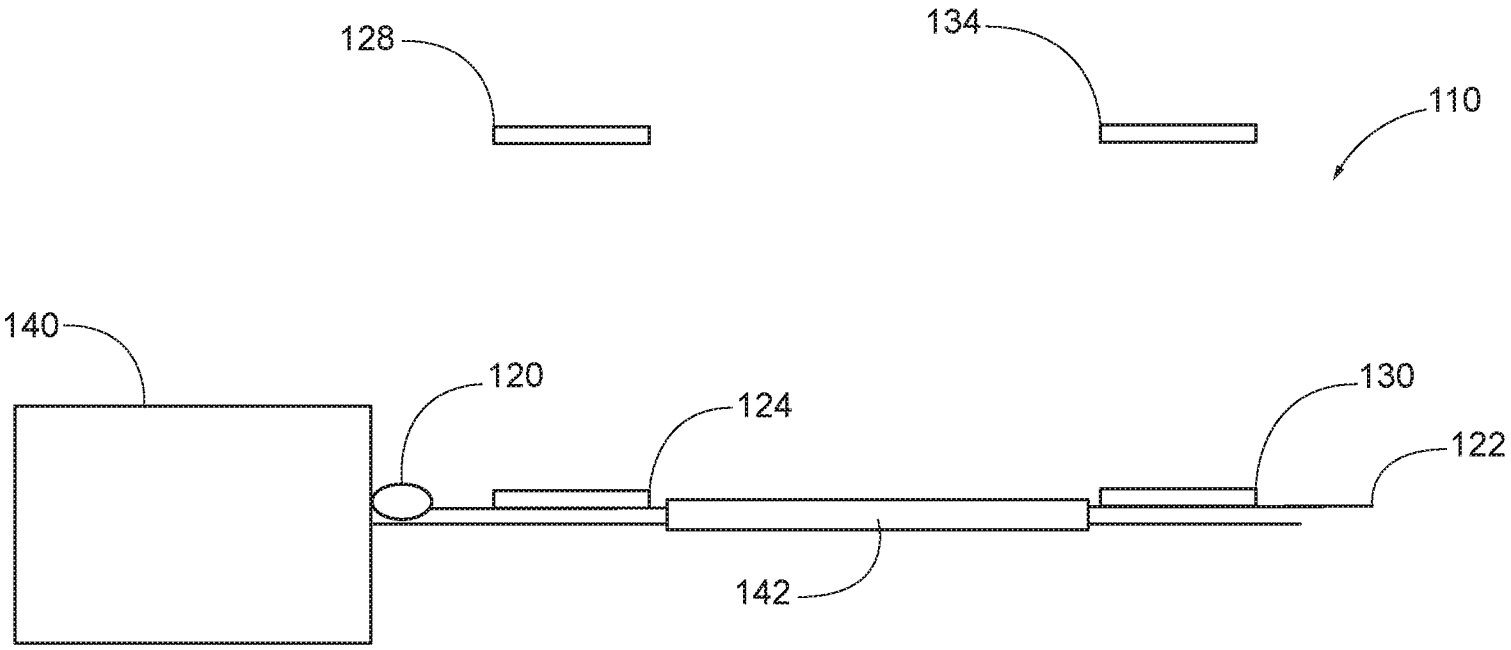
FIG. 11 shows an exemplary boutonniere attachment assembled to a flower.

Turning now to FIG. 11, a decoration 140, such as a boutonniere, may be attached to the boutonniere attachment 110, as shown. To attach the boutonniere attachment 110 to the decoration 140, the stem of the decoration 140 may be placed near the shaft 112 of the boutonniere attachment 110, and optionally the removable attachments 128 and 134 may be removed from the flanges 124 and 130. A suitable attachment, such as a floral tape 142 may then be wrapped around the stem of the decoration 140 and the shaft 112 to attach the stem to the shaft 112. The loop 120 may be left uncovered by the floral tape 142 near a head of the boutonniere, for example as a grip when wrapping. The loop 120 may provide an additional surface for the user to grip along with the shaft 112.

The flanges 124 and 130, may be wrapped in floral tape 142 along with the shaft 112. Wrapping the flanges 124 and 130 in floral tape 142 may increase the surface area of the boutonniere attachment 10 wrapped in floral tape 142, for example as additional support. The additional support may prevent movement of the decoration 140 in relation to the boutonniere attachment 110. Alternatively, the flanges 124 and 130 may be left unwrapped in floral tape 142, for example to provide a stronger magnetic connection between the flanges 124 and 130 and the removable attachments 128 and 134.

After the boutonniere 140 is attached to the boutonniere attachment 110, the boutonniere attachment 110 may be secured to an article of clothing, such as a suit jacket. To secure to the clothing, the user removes or confirms that the removable attachments 128 and 134 have been removed from the flanges 124 and 130. The user then places the boutonniere attachment 140 at a desired position on the outside of the clothing, such as a lapel of the suit jacket.

The boutonniere attachment 110 is then secured to the clothing by magnetically attaching the removable attachments 128 and 134 to the flanges 124 and 130, respectively. The removable attachments 128 and 134 are attached from the interior of the clothing or underside of the lapel, the article of clothing secured between the removable attachments 128 and 134 and the flanges 124 and 130. It will be appreciated that securing the boutonniere attachment 110 to an article of clothing does not require a pin of any type or a lapel buttonhole. For this reason, the boutonniere attachment 110 may be placed in any desired location or orientation. It should also be appreciated that since the boutonniere attachment 110 does not require any pins, the clothing will not need to be punctured to secure the boutonniere attachment 110. This may reduce the number of unwanted holes (i.e., from pins) in the article of clothing, therefore keeping the clothing in a desired condition.

Although certain embodiments have been shown and described, it is understood that equivalents and modifications falling within the scope of the appended claims will occur to others who are skilled in the art upon the reading and understanding of this specification.

What is claimed is:

1. A boutonniere attachment comprising:

a shaft having first and second ends;

a first fastener attached to the shaft proximate the first end, the first fastener including a flange portion attached to the shaft and a removable attachment; and a second fastener attached to the shaft proximate the second end, the second fastener including a flange portion attached to the shaft and a removable attachment, wherein the first end of the shaft includes a loop for a user to grasp while handling the boutonniere attachment.

2. The boutonniere attachment according to claim 1, wherein the first fastener and the second fastener further include a pin projecting from the respective flange portion.

3. The boutonniere attachment according to claim 2, wherein the removable attachment of the first fastener is removably attached to the pin of the first fastener, and the removable attachment of the second fastener is removably attached to the pin of the second fastener.

4. The boutonniere attachment according to claim 3, wherein the removable attachments of the first and the second fasteners are butterfly clutches.

5. The boutonniere attachment according to claim 1, wherein the removable attachments of the first and the second fasteners are rubber clutches.

6. The boutonniere attachment according to claim 1, wherein the removable attachments of the first and the second fasteners are screw-type fasteners.

7. The boutonniere attachment according to claim 1, wherein the removable attachments of the first and the second fasteners are magnetically attached to the respective flange of the first and the second fasteners.

8. The boutonniere attachment according to claim 7, wherein the flanges of the first and the second fasteners are magnets.

9. The boutonniere attachment according to claim 7, wherein the removable attachments of the first and the second fasteners are magnets.

10. A boutonniere attachment comprising:

a shaft having first and second ends;

a first fastener attached to the shaft proximate the first end, the first fastener including a flange portion attached to the shaft and a removable attachment; and a second fastener attached to the shaft proximate the second end, the second fastener including a flange portion attached to the shaft and a removable attachment, wherein the removable attachments of the first and the second fasteners are magnetically attached to the respective flange of the first and the second fasteners.

11. The boutonniere attachment according to claim 10, wherein the flanges of the first and the second fasteners are magnets.

12. The boutonniere attachment according to claim 10, wherein the removable attachments of the first and the second fasteners are magnets.

13. A method of attaching a decoration to an article of clothing using a boutonniere attachment, the boutonniere attachment having a shaft, a first fastener attached to the shaft proximate the first end, the first fastener including a flange portion attached to the shaft, a pin projecting from the flange portion, and a removable attachment removably attached to the pin, and a second fastener attached to the shaft proximate the second end, the second fastener including a flange portion attached to the shaft, a pin projecting from the flange portion, and a removable attachment removably attached to the pin, the method comprising:

placing a stem of the decoration abutting the shaft of the boutonniere attachment;

attaching the stem of the decoration to the shaft of the boutonniere attachment by applying an adhesive to the shaft of the boutonniere and to the stem of the decoration;

piercing the article of clothing with the pins of the boutonniere attachment; and attaching the removable attachments to the pins of the boutonniere attachment to trap the clothing between the pins and the flanges.

14. The method according to claim 13, wherein attaching the stem of the decoration to the shaft of the boutonniere further comprises wrapping a strip material around the shaft of the boutonniere and the stem of the decoration.

15. The method according to claim 14, wherein wrapping the strip material further comprises wrapping the strip material over at least a portion of the flanges of the first and second fasteners.

16. The method according to claim 13, wherein the decoration is a boutonniere having the stem and petals.

* * * * *